United States Patent [19]

Wang et al.

[11] Patent Number: 4,759,267

[45] Date of Patent: Jul. 26, 1988

[54] ENERGETIC FLUID PRODUCT AND ITS APPLICATION TO THE SUPPLY OF COMBUSTIBLE MATTER TO A REACTION CHAMBER

[75] Inventors: Robert Wang, Wissous; Gérard Antonini, Pierrefonds, both of France

[73] Assignee: Creusot-Loire, Paris, France

[21] Appl. No.: 597,860

[22] Filed: Apr. 9, 1984

[30] Foreign Application Priority Data

Apr. 8, 1983 [FR] France ..... 83 05787

[51] Int. Cl.[4] ..... C10L 1/32

[52] U.S. Cl. ..... 44/51; 252/307; 252/308; 252/314

[58] Field of Search ..... 44/51; 48/DIG. 7; 252/307, 308, 314

[56] References Cited

U.S. PATENT DOCUMENTS

| | | | |
|---|---|---|---|
| 3,915,887 | 10/1975 | Okabe et al. | 252/307 |
| 3,954,662 | 5/1976 | Salyer et al. | 252/307 |
| 4,009,095 | 2/1977 | Carson | 252/314 |
| 4,104,035 | 8/1978 | Cole et al. | 44/51 |
| 4,127,383 | 11/1978 | Johnston et al. | 252/307 |
| 4,196,092 | 4/1980 | Wang et al. | 252/307 |
| 4,242,098 | 12/1980 | Braun et al. | 44/51 |
| 4,392,865 | 7/1983 | Grasse et al. | 44/51 |
| 4,395,266 | 7/1983 | Han | 44/60 |

*Primary Examiner*—William R. Dixon, Jr.
*Assistant Examiner*—Margaret B. Medley
*Attorney, Agent, or Firm*—Pollock, Vande Sande & Priddy

[57] ABSTRACT

An energetic fluid product containing finely divided solid combustible matter suspended in at least one liquid phase and capable of being made to circulate in a line for supplying a treatment chamber, and a device for the preparation and a particular application of this product. The solid particles (13) are dispersed homogeneously within a stable foam produced by mixing a gas phase with the liquid phase to which stabilizing and emulsifying products have been added, and the liquid phase consists solely of fine film (12) connecting the solid particles (13) together and confining gas bubbles (11) which occupy the spaces between the solid particles (13). The invention applies in particular to the supply of combustible matter to a combustion chamber or to a reactor for coal gasification.

8 Claims, 2 Drawing Sheets

ENERGETIC FLUID PRODUCT AND ITS APPLICATION TO THE SUPPLY OF COMBUSTIBLE MATTER TO A REACTION CHAMBER

FIELD OF THE INVENTION

The invention relates to an energetic fluid product containing finely divided combustible matter, a device for the preparation of such a product and a particular application of the product to the supply of combustible matter to a reaction chamber.

PRIOR ART

Various combustion or gasification processes are known which employ a reaction chamber supplied with solid combustible matter such as finely divided coal.

The fuel must normally be introduced into the reaction chamber in a continuous manner, and for this purpose it is useful to prepare it in the form of a fluid product capable of being conveyed in feed lines using simple means. It is possible, for example, to employ pneumatic conveying, the particles being suspended in a stream of air, but this produces an auto-ignition and explosion hazard. When inert gas is not available cheaply, it is generally preferred to disperse the particles in a liquid phase to produce a mixture with the consistency of a slurry and capable of being conveyed for example by means of a positive displacement pump. The coal is generally suspended in water but, in this case, the combustion reactions are retarded, which makes it necessary to enlarge the combustion chambers, and the thermal yield of the reaction is greatly reduced since a considerable part of the energy provided serves only to vaporize water. The attempt is therefore to reduce the proportion of water as much as possible relative to the proportion of solid matter. However, as the concentration of solid is increased the viscosity of the product also rises and more energy needs to be employed to pump the product. For a minimum proportion of water, the viscosity of the mixture can be lowered by means of chemical additives, but the latter are costly and moreover can be corrosive.

It has also been proposed to make use of the particle size of the solid particles because it is known that a denser mixture is obtained by employing particles belonging to at least two size ranges. It is then necessary to add to the particles normally employed particles other finer, particles in specified proportions, but the formation of such mixtures with a multimodal particle size distribution is costly, and in any case the quantity of solid matter present cannot exceed 70 to 75%, depending on the nature of the solid.

Now, the finer the particle size of the fuel, the more efficient is its valorization, since the time required for the reaction is a function of particle size. It is therefore advantageous to try to employ fuels with the finest particle size possible this which obviates the use of filters and results in reducing the content of liquid to the maximum degree without, however, reaching a compactness which would prevent pumping for the purpose of introducing the mixture into the reactor.

The problem of the introduction of the combustible matter into a reactor is further complicated by the fact that the reaction yield is better when the reactor operates under pressure, making it necessary also to place the product under pressure if it is intended to introduce it into the reactor continuously. The difficulties in introducing a mixture containing little moisture are then increased.

A consequence of these difficulties is that, until now, the fluid products produced for supplying a reactor with combustible matter generally contains a proportion of liquid which is at least 30%. Of course, the energetic disadvantages of the use of such a proportion of a liquid phase can be reduced if the latter is formed by a liquid fuel but, in this case, the economic benefit of the process is also reduced.

SUMMARY OF THE INVENTION

The invention has as its subject a new energetic fluid product in which the proportion by weight of liquid phase relative to that of the solid particles is appreciably reduced in comparison to the known product and which additionally makes it possible to employ very fine particles.

The fluid product according to the invention consists of a stable foam produced by mixing a gaseous phase with the liquid phase to which stabilizing and emulsifying products have been added and in which the solid particles are homogeneously dispersed, the liquid phase consisting solely of fine films connecting the solid particles together and confining the gas bubbles which occupy the spaces between the solid particles.

In such a product according to the invention, the solid particles can have any particle size distribution and the proportion by weight of solid phase can reach at least 70%.

According to a characteristic of the invention, the gaseous phase can be an inert gas, a combustive gas or a fuel gas.

Another subject of the invention is a device for preparing a fluid product according to the invention comprising a means for preparing a stable foam by incorporating a gaseous phase in a liquid phase to which emulsifying and stabilizing products have been added, and a means for dispersing the particles of combustible matter homogeneously within the foam thus prepared.

In a particularly advantageous embodiment the means for dispersing the solid particles homogeneously in the foam incorporate a double-screw mixer comprising, inside an elongated cylindrical sleeve, an agitator in the shape of a helical ribbon driven in rotation around the axis in a direction which determines the advance from upstream to downstream and over the periphery of the sleeve of the foam introduced through an orifice located at the upstream end, the helical ribbon surrounding an axial free space the upstream part of which is entered by a screw feeder for the introduction of a specified flow of solid particles.

In a particular application, the invention also relates to a process for introducing into a reaction chamber solid combustible matter which is finely powdered and dispersed homogeneously in a stable foam, in which the liquid phase consists solely of the films connecting the solid particles together and confining gas bubbles which occupy the spaces between the particles, the said foam being then made to move in a duct for supplying the reaction chamber.

To prepare the fluid product according to the invention, the foam is preferably first produced by vigorous agitation of the liquid phase in the presence of the gaseous phase, and the solid particles are then dispersed in the foam thus prepared, the latter being capable of being stored in anticipation of subsequent use.

According to an advantageous characteristic, before being introduced into the chamber, the fluid product can be subjected to a pressure rise resulting in an increase in the proportion of solid matter per unit volume, up to a pressure below the limiting pressure starting from which the volume of the compressed product remains constant.

BRIEF DESCRIPTION OF THE DRAWINGS

The following description of a particular embodiment, given by way of example and shown on the attached drawings, will permit the invention to be more clearly understood.

DETAILED DESCRIPTION

Figure 1:
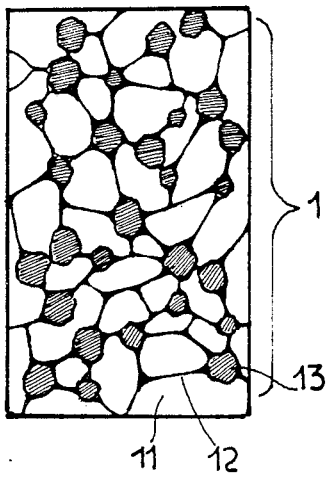
FIG. 1 is a diagram showing on a large scale a sample of the product.

FIG. 1 shows diagrammatically a sample of the product 1 which consists of a foam made of bubbles 11 confined by liquid films 12 in the shape of a meniscus, within which foam solid particles 13 are homogeneously dispersed, joined together by the liquid films 12. The solid particles 13 are shown in symbolized by spheres in the drawing as spheres, but of course, they may be of any shape. The average size of the particles is of the order of 50 microns but can even go down under 20 microns. The gas bubbles 11 can be of the order of a millimeter in size but can microns, may be even smaller than 20 microns. The gas bubbles making it possible to increase the proportion of solid particles incorporated in the foam.

It can be seen that, in such a product, the liquid phase consists solely of the films 12 connecting the particles 13 and that, consequently, the weight proportion of the liquid in the product can be greatly reduced. However, given that the particles are separated from each other by the bubbles, the mixture is pumpable and can be conveyed within ducts by any known means, and behaves as a compressible fluid.

Figure 3:
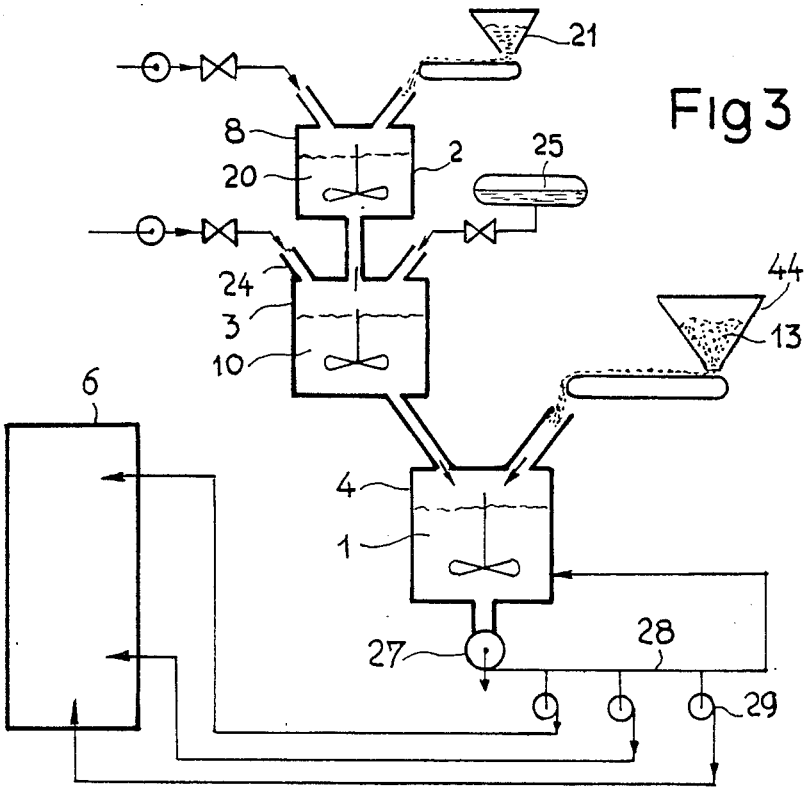
FIG. 3 shows diagrammatically a plant for preparing and using the product.

FIG. 3 shows by way of example a diagram of the preparation of such a product. The liquid phase, for example water, is introduced into a vat 2 in which it is mixed vigorously with a thickener product 21, which is introduced by a metering device and which enables a kind of gel 20 to be produced. The latter is then conveyed to a second vat 23 in which water is also introduced through an entry 24 and an emulsifier product of the surfactant type through a line 25. The whole is mixed vigorously until all the liquid phase has been emulsified with the gas present in the enclosure.

The foam 10 thus produced is directed to a third vat 4 into which the solid particles 13 are poured by means of a metering hopper 44. The whole is vigorously stirred to disperse the solid particles homogeneously within the product 1 which is then in the form shown diagrammatically in FIG. 1.

The thickener 21 introduced into the vat 2 makes it possible to stabilize the emulsion by suppressing spontaneous ruptures of the liquid films providing the partitioning of the foam, and thus ensures that the solid particles are kept in suspension. It is possible to employ hygroscopic non-volatile soluble products such as carboxymethylcellulose or, for example, glycerol, dodecane or polyvinylalcohol.

The emulsifier product 25 is a surfactant which makes it possible to emulsify the gas in water. It is possible to employ an alkylarylsulfonate or another known foaming agent, for example a saponified fatty acid, an amine, quaternary ammonium, alkylpolyethoxyetherphosphate and the like.

As an example, a product has been produced in which the liquid phase prepared before the addition of the gas contained 1% of surfactant and 0.2% of stabilizer.

Given that the separation of the solid particles which ensures the fluidity of the product is produced by the presence of gas bubbles of negligible weight, it is possible in fact to incorporate in the product a very considerable proportion by weight of solid phase without the need to combine particles of different particle sizes.

Thus it has been possible to prepare a fluid product containing 75% by weight of powdered coal, 80% of whose particles had a diameter below 80 microns.

It should be noted, moreover, that the presence of air in the form of gas bubbles in the mixer is not dangerous, even in a considerable proportion, because the coal particles are coated with the liquid films confining the bubbles, and because the latter reduce the danger of oxidation of the particles which might produce a rise in temperature.

To employ the foam, it can be circulated by means of a pump 27 in a closed circuit 28 from which the foam needed is withdrawn by the metering pumps 29. It is also possible to place the circuit 28 under pressure and to replace the metering pumps by simple inlet valves making it possible, for example, to feed the burners of a reaction chamber 6.

In fact, according to an advantageous characteristic, the fluid product consisting of the stabilized foam can be subjected to a pressure rise which determines a reduction in the size of the bubbles and brings the particles closer together and consequently produces an increase in the density of the product.

When the product is at atmospheric pressure, the coal particles dispersed randomly in the foam are practically out of contact with each other. The mixture is then easily pumpable.

When the pressure P applied to the product is increased, the particles come closer together, the bubbles being reduced in diameter. However, the product remains pumpable so long as the particles remain sufficiently separated from each other.

Figure 2:
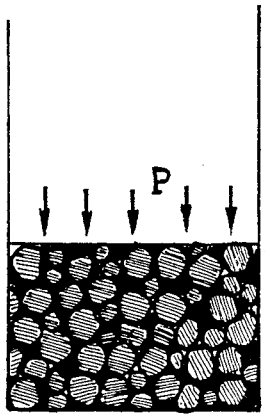
FIG. 2 is a diagram of the product after compression up to the limiting pressure.

There is therefore a limiting pressure P starting at which, as shown in FIG. 2, the coal particles are arranged according to a close packing. In this case, the mixture is no longer pumpable, the friction between the particles resisting their motions.

It follows that the pressure increase applied to the liquid product must remain below the limit starting from which the specific volume of the product is no longer reduced when the pressure is increased.

This limit depends on the concentration of solid particles and can be determined either empirically, by a series of tests, or by calculation.

It is known, for example, that a close packing of a unimodal particle size distribution incorporating 80% of particles of a size below 80 microns corresponds to a porosity of approximately 0.4. This means that, in a close packing, the volume occupied by the solid particles is 60% of the total.

Moreover, it has been determined experimentally that, at a proportion of solid particles of 75% by weight, a kilogram of product occupies a volume of approximately two liters. By comparing the gas to a perfect gas and applying Mariotte's law, it is therefore possible, using these data and starting from atmospheric pressure, to determine the limiting pressure rise beyond which the volume occupied by a specified mass of product no longer varies. For example, in the case of a product based on coal, air and water and containing 75% by weight of coal, the limiting pressure is of the order of 9 bars. Care will therefore be taken, in respect of the use circuit 27, 28 and 29, not to reach this pressure, at which a complete blockage of the lines would be produced.

This pressure may be found to be too low for feeding a gasification reactor. Nevertheless, it has been calculated for a product prepared at atmospheric pressure and at ambient temperature. Now, it can be shown that when the product is prepared at an absolute pressure above atmospheric pressure, for example 5 bars, the limiting pressure can reach 45 bars. Furthermore, the limiting pressure is also a function of the relationship between the temperature of use and the temperature of preparation. Thus, in the case where the product is prepared at 20° C., the limiting pressure can be increased by 10% if, at the time of use, the temperature is increased to 50° C., provided of course that the foam remains stable at such a temperature.

Figure 4:
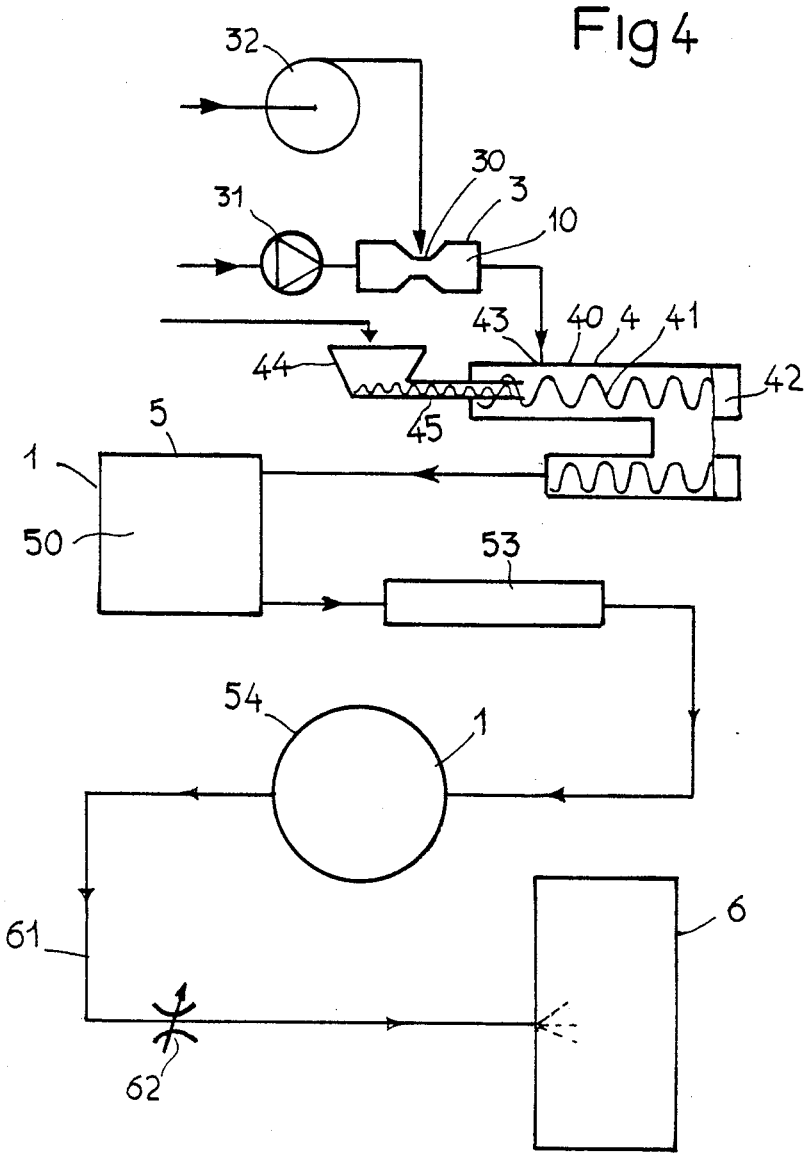
FIG. 4 shows diagrammatically another embodiment of a plant for preparing and using the product.

FIG. 4 shows, by way of example, a plant for the preparation under pressure of a fluid product based on coal, air and water.

The aqueous solution prepared, as in the case of FIG. 3, by mixing water with a thickener and then an emulsifier, is delivered by a pump 31 to a device 3 for preparing the foam, consisting of a pipe in the middle of which is placed a venturi 30. Air is blown into the venturi by a compressor 32 and is thus incorporated in the aqueous solution to form a foam which is directed to the mixer 4. The latter, which can incorporate several components in line, consists essentially of a stirrer in the shape of a helical ribbon 41 driven in rotation around its axis by a motor 42 inside a cylindrical sleeve 4 equipped with an opening 43 for the entry of the foam placed at the upstream end in the direction of movement of the product resulting from the rotation of the helical ribbon 41. The latter, moreover, encloses a free axial space into which enters a screw feeder of a known type, comprising a hopper 44 provided at its base with a screw driven in rotation around its axis and which projects into a tube 45 opening out into the free space determined by the helical ribbon 41 in the axis of the sleeve 4.

As a result, the foam prepared in the device 3 and entering the sleeve 4 through the orifice 43 is driven downstream along the inner periphery of the sleeve by the rotation of the ribbon 41 and picks up the finely divided coal which is poured into the hopper 44 and which therefore is incorporated within the foam at a flow rate determined by the rotation of the screw. It is possible in this way to obtain a perfectly homogeneous dispersion of solid particles within the foam.

Such a mixture can operate at a low pressure below the limiting pressure, for example of three to six bars, and supply in this way a main vessel 5 maintained at the desired pressure.

The product prepared in this way can therefore be stored in advance in a vessel maintained under a low pressure.

If the product is to be injected into the reactor under a higher pressure, it is advantageous to pass through a buffer vessel 51 which is under a pressure above the pressure of use, for example ten bars. The buffer vessel 51 is supplied from the main vessel 5 by a positive displacement pump fitted with a device for forced feeding. In fact, the high proportion of gas present in the product stored in the vessel 5 could give rise to irregular and random delivery. The forced feeding device could consist very simply of an Archimedean screw placed in the bottom of the storage vessel 5 and feeding a positive displacement pump 52.

After the buffer vessel 51 it is possible to introduce the fluid product directly into the reactor 6 by means of a feed line 61 fitted with a throttle valve 62 ensuring the let-down of the product down to the required pressure.

If the buffer vessel 51 is at a pressure above the pressure of use, the release of the compressed gas present in the bubbles at the time of the injection into the reactor promotes the spraying of the fluid product and disperses the coal particles very efficiently in the reactor enclosure. In view of the fineness of the particles which can be reached by virtue of the process according to the invention, a real atomization of the combustible matter is produced in the reactor.

Furthermore, in general, the possibility of employing, by virtue of the invention, coal of a particularly fine particle size presents a considerable advantage, the valorization of the fuel being the higher in proportion as its particle size is finer, since the time required for the reaction is a function of the particle size.

It will also be noted that the three-phase composition position of the product, with a high proportion of gas, reduces the probability of impact of the particles against the walls, since the particles are held within the bubbles forming the foam, and as a result reduces the erosion of the injection devices.

In addition, the possibility of preparing the product in advance in a stable, storable and directly usable form is a major advantage because it makes it possible to separate the plant for preparing the product from the users, the latter having to make provision only for the devices for pressurization and injection into the reactor of a prefabricated fluid product.

Moreover, for the same proportion of coal, a foam according to the invention is transported in pipes with a smaller loss of pressure. It could thus be advantageous to prepare the combustible fluid product in a place eventually located very far from the place of utilization, for example near a coal-mine or to port, and to transport the prefabricated fluid product to a combustion installation which could be several hundreds miles away.

Due to the small loss of pressure, the need of energy for transportation would be reduced.

For example the losses of pressure for transporting in same pipe a fluid product according to the invention and a conventional coal-water mixture with the same proportion of coal were compared for different flows by weight.

In this example, with a coal containing 80% of particles of a size below 80 microns, the composition by weight of the foam product was:

coal: 70%
water: 28.5%
surfactant: 1.5%
stabilizer: 0.07%

The increase in the loss of pressure caused by increasing the flow is small: In a pipe of diameter 25.5 mm the loss of pressure was respectively. In a pipe of diameter 25.5 mm the loss of pressure was respectively 0.12 bar/m for a flow by weight of 0.10 kg/sec and 0.20 bar/m for 0.25 kg/sec.

By contrast, for a conventional coal-water mixture containing 70% by weight of coal, the increase in the loss of pressure caused by increasing the flow was significant: For the same flow of 0.10 and 0.25 Kg/sec, the losses of pressure were, respectively 0.20 and 1.10 bar/m.

Due to this reduction of the loss of pressure it is thus possible to transport over long distances a concentrated product directly utilizable in a reactor without necessiting any dewatering.

While the product has been described for the case of a coal-water-air mixture, it is quite obvious that different solid fuel could be employed with a liquid phase and a gas phase of another kind. In general, the proportion of liquid phase needs to be as low as possible because the use of water reduces the energy yield and a liquid fuel is more costly. On the other hand, the gas phase is generally useful in the reaction, and it would be possible, for example, to employ as the gas phase either a combustive gas or a fuel gas. 0,12 bar/m for a flow by weight 94 of 0,10 kg/sec and 0,20 bar/m for 0,25 kg/sec.

In return, for a classical Coal-Water mixture containing 70% by weight of coal, the increasing of the loss of pressure by increasing the flow was important: For the same flow of 0,10 and 0,25 Kg/sec, the losses of pressure were, respectively 0,20 and 1,10 bar/m.

Due to this reduction of the loss of pressure, it is thus possible to transport on long distances a concentrated product directly utilizable in a reactor without necessiting any dewatering.

The arrangements just described are given, of course, only by way of example and other devices could be employed, permitting a foam to be produced and solid particles to be incorporated therein.

Furthermore, while the product has been described for the case of a coal water air mixture, it is quite obvious that different solid fuel could be employed with a liquid phase and a gas phase of another kind. It would be noted that, in general, the proportion of liquid phase needs to be as low as possible because the use of water reduces the energy yield and a liquid fuel is more costly. On the other hand, the gas phase is generally useful in the reaction and it would be possible, for example, to employ as the gas phase either a combustive gas or a fuel gas.

We claim:

1. Energetic fluid product containing finely divided solid combustible matter suspended in at least one liquid phase and capable of being circulated in a duct for feeding a treatment chamber, wherein solid particles (13) are constituted by powdered coal and the proportion by weight of solid phase is about 75%, said solid particles (13) being homogeneously dispersed within a stable foam produced by mixing a gas phase with said liquid phase to which stabilizing and emulsifying products have been added, and said liquid phase consists solely of fine films (12) connecting said solid particles (13) together and confining gas bubbles (11) which occupy spaces between said solid particles (13).

2. Energetic fluid product as claimed in claim 1, wherein said gas phase is a combustive gas.

3. Energetic fluid product as claimed in claim 1, wherein said gas phase is a fuel gas.

4. Energetic fluid product as claimed in claim 1, wherein said stabilizing product is a carboxymethylcellulose and said emulsifying product is a surfactant of the alkylarylsulfonate type.

5. Process for supplying a reaction chamber (6) with a finely divided solid combustible matter suspended in at least one liquid phase to form a fluid product capable of being circulated in a feed line (61) opening out in said reaction chamber (6), wherein particles (13) of solid matter are dispersed homogeneously in a stable foam (1) produced by mixing a gas phase with a liquid phase to which a stabilizing product and an emulsifying product have been added and containing only the quantity of liquid phase required for the formation of films (12) connecting said solid particles (13) together and confining gas bubbles (11) occupying spaces between said particles (13), said foam (1) then being made to circulate in said line for supplying said reaction chamber.

6. Process as claimed in claim 5, wherein a foam is first produced by vigorous mixing of said liquid phase with said gas phase and said solid particles are then dispersed in the foam thus prepared, the latter being capable of being stored for subsequent use.

7. Process as claimed in claim 5, for supplying a reaction chamber (6) with a combustible matter wherein, before its entry into said chamber (6), said fluid product (1) is subjected to a pressure rise capable of increasing the proportion of solid matter (13) per unit volume up to a pressure below a limiting pressure beyond which the volume of compressed product remains constant.

8. Process as claimed in claim 5, wherein said fluid product is prepared in a location remote from the place of utilization, said reaction chamber being connected with a preparation device by an extended supply pipe.

* * * * *

UNITED STATES PATENT AND TRADEMARK OFFICE

CERTIFICATE OF CORRECTION

PATENT NO. : 4,759,267

DATED : July 26, 1988

INVENTOR(S) : Robert Wang et al.

It is certified that error appears in the above-identified patent and that said Letters Patent is hereby corrected as shown below:

On the title page, Item [75] insert -- Olivier Francois, Compiegne and Alain Touret, Margny-Les-Compiegne, France --.

Signed and Sealed this

Fourteenth Day of March, 1989

*Attest:*

*Attesting Officer*

DONALD J. QUIGG

*Commissioner of Patents and Trademarks*